US008863908B2

(12) United States Patent
Villa et al.

(10) Patent No.: US 8,863,908 B2
(45) Date of Patent: Oct. 21, 2014

(54) CONTROLLING A DRIVE MOTOR OF AN ELEVATOR INSTALLATION

(75) Inventors: Valerio Villa, Gironico (IT); Yong Qi Cui, Shanghai (CN)

(73) Assignee: Inventio AG, Hergiswil NW (CH)

( * ) Notice: Subject to any disclaimer, the term of this patent is extended or adjusted under 35 U.S.C. 154(b) by 577 days.

(21) Appl. No.: 13/224,641

(22) Filed: Sep. 2, 2011

(65) Prior Publication Data

US 2012/0222917 A1 Sep. 6, 2012

(30) Foreign Application Priority Data

Sep. 9, 2010 (EP) ..... 10175981

(51) Int. Cl.

| | |
|---|---|
| ***B66B 1/28*** | (2006.01) |
| ***B66B 1/24*** | (2006.01) |
| ***B66B 1/34*** | (2006.01) |
| ***B66B 1/30*** | (2006.01) |

(52) U.S. Cl.

CPC ... *B66B 1/30* (2013.01); *B66B 1/24* (2013.01); *B66B 1/285* (2013.01); *B66B 1/3492* (2013.01); *B66B 1/302* (2013.01)

USPC ..... 187/295; 187/393

(58) Field of Classification Search

USPC ..... 187/247, 290, 293, 295, 296, 297, 187/391–393

See application file for complete search history.

(56) References Cited

U.S. PATENT DOCUMENTS

| | | | | | |
|---|---|---|---|---|---|
| 4,456,097 | A | * | 6/1984 | Salihi | 187/289 |
| 4,483,419 | A | * | 11/1984 | Salihi et al. | 187/296 |
| 4,501,343 | A | * | 2/1985 | Salihi | 187/296 |
| 4,982,816 | A | * | 1/1991 | Doi et al. | 187/296 |
| 5,373,120 | A | * | 12/1994 | Barrett et al. | 187/316 |
| 5,896,950 | A | | 4/1999 | Koh | |
| 8,668,055 | B2 | * | 3/2014 | Spirgi | 187/393 |
| 2009/0133964 | A1 | * | 5/2009 | Ueda et al. | 187/254 |
| 2012/0186916 | A1 | * | 7/2012 | Kigawa et al. | 187/393 |

FOREIGN PATENT DOCUMENTS

| | | | |
|---|---|---|---|
| JP | 03138273 A | * | 6/1991 |
| WO | 0170613 | | 9/2001 |

* cited by examiner

*Primary Examiner* — Anthony Salata
(74) *Attorney, Agent, or Firm* — Stroock & Stroock & Lavan LLP

(57) ABSTRACT

A movement of an elevator cage is detected by an elevator control on the basis of signals of a rotary encoder, coupled with a rotational movement of the drive motor or the drive pulley. Before movement of the cage begins, a movement plot in the form of a trip/speed profile is calculated for travel of the elevator cage from an instantaneous elevator cage position to a destination stopping point position. An anticipated slip between the drive pulley and a support means is included in the calculation of the trip/speed profile, and during the travel of the elevator cage a rotational movement of the drive motor and thus of the drive pulley is controlled by the elevator control in dependence on the calculated trip/speed profile and on signals of the rotary encoder.

18 Claims, 5 Drawing Sheets

$G_{Gg} > G_{Ak}$

8 DRIVE MOTOR
9 DRIVE PULLEY
12 INCREMENTAL ROTARY ENCODER
1 ELEVATOR INSTALLATION
COUNTER WEIGHT
4
$G_{Gg}$
$d_{t/auf}$
$d_{e/auf}$
$S_{auf}$
5
SUPPORT MEANS
$G_{Ak}$
3
$d_{t/ab}$
$d_{e/ab}$
$S_{auf}$
$S_{ab}$
$S_{tot}$
STOPPING POINT SENSOR
15
14.1
LOWER EDGE
13.1
STOPPING POINT MARKING

CONTROLLING A DRIVE MOTOR OF AN ELEVATOR INSTALLATION

CROSS-REFERENCE TO RELATED APPLICATION

This application claims priority to European Patent Application No. 10175981.9, filed Sep. 9, 2010, which is incorporated herein by reference.

FIELD

The disclosure relates to controlling a drive motor of an elevator installation.

BACKGROUND

Methods of controlling the drive motor of elevator installations can differ, for example, in the form of speed control and in the form of detection of the position of the elevator cage.

In the case of elevator installations for high demands with respect to travel speed and transport capacity the position of the elevator cage can be detected by an absolute position measuring system, which supplies to the elevator control information, from which the elevator control recognizes the current position of the elevator cage. The travel speed is regulated in correspondence with a trip/speed profile, the course of which is determined in dependence on the trip distance between a start position and a destination position before the start of the trip.

In the case of elevator installations for moderate demands with respect to travel speed and transport capacity the position of the elevator cage is often detected by a position detection system with a travel transmitter. Such a travel transmitter is often constructed as an incremental rotary encoder and is driven by the movement of the elevator cage by means of a transmission mechanism. In one often-employed form of embodiment, an incremental rotary encoder is coupled with the rotating axle of the cable pulley of a speed limiter, wherein a wire cable transmits the movement of the elevator cage to the cable pulley of the speed limiter and thus forms the mentioned transmission mechanism.

A travel transmitter supplies to the elevator control signals from which the elevator control can derive trip distances, speed and acceleration of a movement of the elevator cage. The information about the position of the elevator cage can be detected by summation of the detected trip distances. It can therefore be falsified or lost, for example as a consequence of disturbances in the signal transmission or interruptions in the power supply, which can require measures for reinstatement of the correct position in the position detecting system.

Such a position detecting system for an elevator cage of an elevator installation is known from WO 01/70613. In the described equipment the elevator control registers the current position of the elevator cage over the entire trip distance on the basis of signals of an incremental rotary encoder coupled with the cable pulley of a speed limiter and thus with the movement of the elevator cage. However, noise pulses and, in particular, slips in the cable drive coupling the movement of the elevator cage with the incremental rotary encoder produce deviations between the instantaneously registered position of the elevator cage ascertained on the basis of the signals of the incremental rotary encoder and the actual instantaneous cage position. In order to provide compensation for the effect of such disturbing influences, the instantaneously registered position of the elevator cage is corrected on arrival of the elevator cage at a destination stopping point and/or movement past intermediate stopping points. This is carried out in that, with the help of a stopping point sensor mounted on the elevator cage, a respective stopping point marking associated with a specific stopping point is detected, whereupon the position of the elevator cage instantaneously registered in the elevator control is corrected in correspondence with the stored stopping point position value associated with the respective stopping point. Moreover, the elevator control is conceived so that a stored stopping point position value is corrected when this gives repeated cause for significant corrections, which are effective in the same direction, of the instantaneously registered position of the elevator cage.

In the cited prior art, in which the slip corrections are undertaken only on reaching the stopping point marking of the destination stopping point, the movement of the elevator cage into the region of the stopping point marking has to be carried out at reduced travel speed. This is due to the fact that the slip arising in the coupling between the movement of the elevator cage and the movement of the incremental rotary encoder can lead to such a large deviation of the instantaneously registered elevator cage position from the actual instantaneous elevator cage position that the position-dependent travel speed, which is present on movement of the elevator cage into the region of the stopping point marking of the destination stopping point, of the elevator cage can be so high that braking until reaching the destination stopping point position is no longer possible. Such a situation leads to disruptions of the normal operation and can even lead to shutdown of the elevator installation. The stated slip-dependent deviation can, however, also be of such a kind that the travel speed of the elevator cage present when the elevator cage moves into the region of the stopping point marking of the destination stopping point is already too low, so that in order to reach the destination stopping point position an extended trip at low speed and correspondingly increased journey time is required.

SUMMARY

At least some embodiments of the disclosed technologies comprise a method, which can be optimized with respect to travel time, for controlling a drive motor of an elevator installation. Further embodiments comprise a method that does not require additional travel transmitters for direct detection of the movement of the elevator cage.

Some embodiments comprise a method of controlling a drive motor of an elevator installation, in which elevator installation an elevator cage can be moved along a trip path by the drive motor by way of a drive pulley and at least one flexible support means and stopped at stopping point positions of a plurality of stopping points. In that case, movement of the elevator cage is detected by a drive control on the basis of signals of a rotary encoder coupled with a rotational movement of the drive motor or the drive pulley and, before the start of travel of the elevator cage, a movement plot in the form a trip/speed profile for a journey of the elevator cage from an instantaneous elevator cage position to a destination stopping point position is calculated by an elevator control, wherein an anticipated slip between the drive pulley and the support means is calculated into the computation of the trip/speed profile so as to be able to aid in maintenance of the calculated movement plot notwithstanding slip. During travel of the elevator cage a rotational movement of the drive motor and thus the drive pulley is controlled by the elevator control in dependence on the calculated trip/speed profile and on signals of the rotary encoder.

By the term "support means" is to be understood in the present disclosure flexible traction means in the form of, for example, steel wire cables, flat belts, wedge-ribbed belts or link chains suitable for carrying and driving an elevator cage and a counterweight.

By the term "elevator control" is to be understood, for example, all control components participating in the control of the elevator installation regardless of their function and arrangement in the elevator installation.

Suitable as rotary encoder are devices in which the rotational movement of the drive motor is detected by, for example, scanning of apertured discs, slotted discs, graduated discs or magnetic pole discs, wherein the scanning can be carried out by means of, for example, light barriers, laser reflection scanners, inductive sensors or magnetic sensors.

In at least some embodiments, the incremental rotary encoder, which is sometimes required in prior art, and which is coupled with the cable pulley of the speed limiter, for detection of movement of the elevator cage, can be saved. Also saved can be the device for evaluating this incremental rotary encoder, as well as the outlay on installation thereof. This is achieved in that for detection of movement of the elevator cage use can be made of the signals of a rotary encoder already present for regulation of the rotational speed of the drive motor. However, this rotary encoder detects the rotational movement of the drive motor or the drive pulley.

The information, which is supplied by it, about the movement of the elevator cage can therefore be subject to an error caused by slip between drive pulley and support means and dependent on the cage loading and the travel direction.

Through the calculation and predetermination of a slip-corrected trip/speed profile it is made possible to carry out journeys of the elevator cage between an instantaneous elevator cage position and a destination stopping point in shortest possible travel time, i.e. with an optimum trip/speed profile. The taking of the anticipated slip into consideration in the calculation of the trip/speed profile can mean that the elevator cage on reaching the destination stopping point, i.e. on detection of the start of a stopping point marking associated with the destination stopping point, has with greater accuracy the optimum travel speed computed for this situation. This optimum travel speed can be that speed at which braking of the elevator cage at permissible retardation values is still safely possible within a travel distance, which corresponds with half the length of the stopping point marking, up to the correct stopping point position.

According to an embodiment of the method, before start of travel of the elevator cage an actual trip distance between an instantaneous elevator cage position and a destination stopping point position is calculated by the elevator control on the basis of the known stopping point position values registered in the elevator control, a slip-corrected trip distance is calculated on the basis of this actual distance and the anticipated slip between the drive pulley and the support means and the trip/speed profile for travel of the elevator cage from the instantaneous elevator cage position until reaching the destination stopping point position is calculated on the basis of this slip-corrected trip distance. Through calculation of the anticipated slip into the trip distance calculated for the intended journey of the elevator cage, and thus into the calculation of the trip/speed profile optimized for this trip distance, one of the preconditions for reaching the stopping point marking of the destination stopping point with the highest possible travel speed calculated for this situation and thus for a shortest possible journey time is fulfilled.

According to a further embodiment of the method, the stopping point positions are characterized by stopping point markings and the stopping point markings are detected by at least one stopping point sensor mounted on the elevator cage, wherein the stopping point markings of all stopping points as measured in the travel direction of the elevator cage are formed to be of equal length and at least of sufficient length for stopping of the elevator cage within half the length of the stopping point markings to be possible, and the stopping point markings and the stopping point sensor are so arranged that a cage floor of the elevator cage is disposed at a level of a stopping point position when the elevator cage in upward travel or downward travel after detection of a start of a stopping point marking is still moved on by half the length of the stopping point marking. With such a form of a method a sufficiently precise positioning of the elevator cage relative to the stopping points can be realized particularly simply and economically.

According to a further embodiment of the method, the drive motor is so controlled during travel of the elevator cage that the elevator cage is moved in correspondence with the calculated trip/speed profile from the instantaneous elevator cage position until reaching a stopping point marking of an intermediate stopping point or a destination stopping point, wherein on reaching such a stopping point marking, a correction of the instantaneous elevator cage position registered in the elevator control and a corresponding correction of the trip/speed profile for the residual distance still to be covered by the elevator cage up to the destination stopping point position are carried out. In at least some cases, this allows for an improved likelihood of reaching the stopping point marking of the destination stopping point at the optimum travel speed calculated for this situation. Termed as intermediate stopping points in the present disclosure are those stopping points the elevator cage passes on its route from its instantaneous position to a destination stopping point associated with the current journey.

According to a further embodiment of the method, slip factors of different size, the magnitude of which is dependent on a cage loading present in the case of the respective journey of the elevator cage, are calculated into the calculation of the slip-corrected travel distance.

In at least some embodiments, through the use of slip factors having a magnitude which has been ascertained for journeys of the elevator cage with cage loads of different levels, the accuracy and efficiency of the method according to the invention are further optimized.

According to a further embodiment of the method, the placing into operation of an elevator installation operated in accordance with the method comprises ascertaining all stopping point positions. This takes place in that when the elevator installation is placed in operation a learning trip of the elevator cage, possibly without a cage load, is performed in which the stopping point position values of all stopping points are ascertained and registered. After conclusion of the learning trip, a learning trip slip factor is ascertained and the registered stopping point position values are corrected in dependence on the ascertained learning trip slip factor. This process makes it possible to register all stopping point position values of a newly installed elevator installation with sufficient accuracy and small expenditure of time, even though the coupling of the rotary encoder with the movement of the elevator cage is subject to slip.

According to a further embodiment of the method, the learning trip is executed without a cage load or with a cage load of less than 30% of the rated load. This method variant, which is realizable thanks to the slip correction, can save the laborious loading and unloading of the elevator cage for performance of the learning trip.

According to a further embodiment of the method, the elevator cage in the case of the learning trip initially executes an outward journey in upward or downward direction, in which a stopping point sensor mounted on the elevator cage initially detects a zero position marking and subsequently the stopping point markings of all stopping points, and subsequently the elevator cage executes a return journey, in which the stopping point sensor again reaches and detects the zero position marking. In the case of detection of a respective one of the stopping point markings by the stopping point sensor on the outward journey a travel distance, which is detected by the rotary encoder, from the zero position marking up to the start of the detected stopping point marking is then corrected by half the length of the stopping point marking and registered as stopping point position value. This embodiment of the method can enable a simple and time-saving detection of the stopping point position values of all stopping points of the elevator installation.

According to a further embodiment of the method, the afore-mentioned learning trip slip factor is ascertained in that the travel distance between a defined point in the region of the start of the outward journey and a reversal position of the end of the outward journey is detected on the basis of the signals of the rotary encoder, the travel distance between the reversal position at the end of the outward journey and the defined point in the region of the start of the outward journey is detected on the basis of the signals of the rotary encoder, and after the learning trip has been concluded a difference between the two detected travel distances—which difference represents the total slip occurring during the outward and return journeys—is divided by the total travel distance detected in the outward and return journeys. This embodiment of the method can enable an extremely simple determination of a learning trip slip factor, by which the stopping point position values ascertained by a measurement subject to slip can be corrected.

According to a further variant of embodiment of the method—as a basis for the calculation of the anticipated slip into the calculation of the trip/speed profile—actual value slip factors dependent on the instantaneous cage loading are determined. This is carried out in that after journeys of the elevator cage in normal operation of the elevator installation on each occasion a first value for a defined travel distance between the start stopping point and the destination stopping point is ascertained on the basis of the signals of the rotary encoder, a second value for the defined travel distance is ascertained on the basis of the registered stopping point position values of the start stopping point and the destination stopping point, and the quotient of the first and the second values is dynamically stored as actual value slip factor in association with one of a plurality of cage loading ranges, wherein for determination of this association the cage loading present in the respective journey of the elevator cage is detected by the elevator control. By the term "defined travel distance" is understood a travel distance precisely detectable by the stopping distance sensor and known or calculable from the results of the learning trip, for example a distance, which is detected by the stopping point sensor and on the other hand calculable from the stopping point positions, between the end of the stopping point marking of the start stopping point and the start of the stopping point marking of the destination stopping point. Such an embodiment of the method forms the basis for further embodiments, in which by way of a load-dependent slip factor a calculated actual travel distance between an instantaneous elevator cage position and a destination stopping point position of a journey to be carried out is corrected, wherein the corrected travel distance then forms the basis for calculation of the trip/speed profile for control of the drive motor during travel of the elevator cage.

By the term "dynamically stored" is understood in the present context a storage of values according to the FIFO (first in-first out) principle. In this principle, for example, the values of respectively recalculated actual value slip factors are registered in a first memory line in, for example, a FIFO memory comprising a series of memory lines, wherein the existing contents of all memory lines are displaced by one position in the series and the content of the last storage location is lost.

According to a further embodiment of the method, each of the calculated actual value slip factors is stored in association with one of a plurality of cage loading ranges or not only with one of a plurality of cage loading ranges, but also with one of the two travel directions, wherein the association is carried out in correspondence with the cage loading or the travel direction which was present in the journey of the elevator cage in which the respective actual value slip factor was ascertained. A basis is thus created for making available load-dependent slip factors by which the trip/speed profiles of future journeys of the elevator cage can be calculated with consideration of the anticipated slip between the drive pulley and the support means.

According to a further embodiment of the method, the elevator control comprises a table memory in which a table column is associated with one of a plurality of cage loading ranges or not only one of a plurality of cage loading ranges, but also one of the two travel directions, wherein the actual value slip factors calculated after journeys of the elevator cage are dynamically stored in that respective one of the table columns which is associated with that cage loading range or that travel direction which includes the cage loading or travel direction present in the respectively concluded journey of the elevator cage. It is achieved by such a form of the method that actual value slip factors ascertained in conjunction with a specific cage loading range can be stored in association with the corresponding cage loading range so that they can be called up after further processing for calculation of trip/speed profiles of future journeys of the elevator cage with the same cage loading range.

According to a further embodiment of the method, in each instance a limited number of last-calculated actual value slip factors, respectively associated with one of the table columns, is dynamically stored in the table columns, a mean value for the load-dependent slip factors stored therein is periodically calculated for each of the table columns and these mean values are made available as information in the form of current load-dependent slip factors for calculation of trip/speed profiles for movements of the elevator cage from a respective instantaneous elevator cage position until reaching a destination stopping point position. The periodic determination of mean values of the last-stored actual value slip factors each associated with a respective cage loading range can make it possible to make available current load-dependent slip factors, which take into consideration not only the currently present cage loading, but also changes over time of the slip occurring between drive pulley and support means.

According to a further embodiment of the method, during a journey of the elevator cage an instantaneously registered elevator cage position is continuously ascertained in the elevator control by way of the signals of the rotary encoder, and on the basis of the instantaneously registered elevator cage position and the trip/speed profile calculated before the travel of the elevator cage, the instantaneous rotational speed of the drive motor or the drive pulley is controlled by the elevator control, wherein on detection of stopping point marking of an intermediate stopping point lying between a start stopping point and the destination stopping point a correction of the instantaneously registered elevator cage position is carried out on the basis of the stopping point position value associated with this stopping point marking in the learning trip.

In some embodiments, in the case of long journeys of the elevator cage over several stopping points the deviations, which still arise despite slip compensation, between the instantaneously registered and the actual elevator cage position are not summated.

According to a further embodiment of the method, after correction of the instantaneously registered elevator cage position, the travel distance between the instantaneously registered elevator cage position and the destination stopping point position is recalculated and corrected by the current load-dependent slip factor, and on the basis of the recalculated travel distance corrected by the current load-dependent slip factor a new trip/speed profile for travel of the elevator cage from the instantaneously registered elevator cage position to the destination stopping point position is calculated. A further reduction in the deviation of the travel of the elevator cage from an optimum trip/speed profile can thereby achieved.

BRIEF DESCRIPTION OF THE DRAWINGS

Exemplifying embodiments are explained in the following on the basis of the accompanying drawings, wherein.

DETAILED DESCRIPTION

Figure 1:
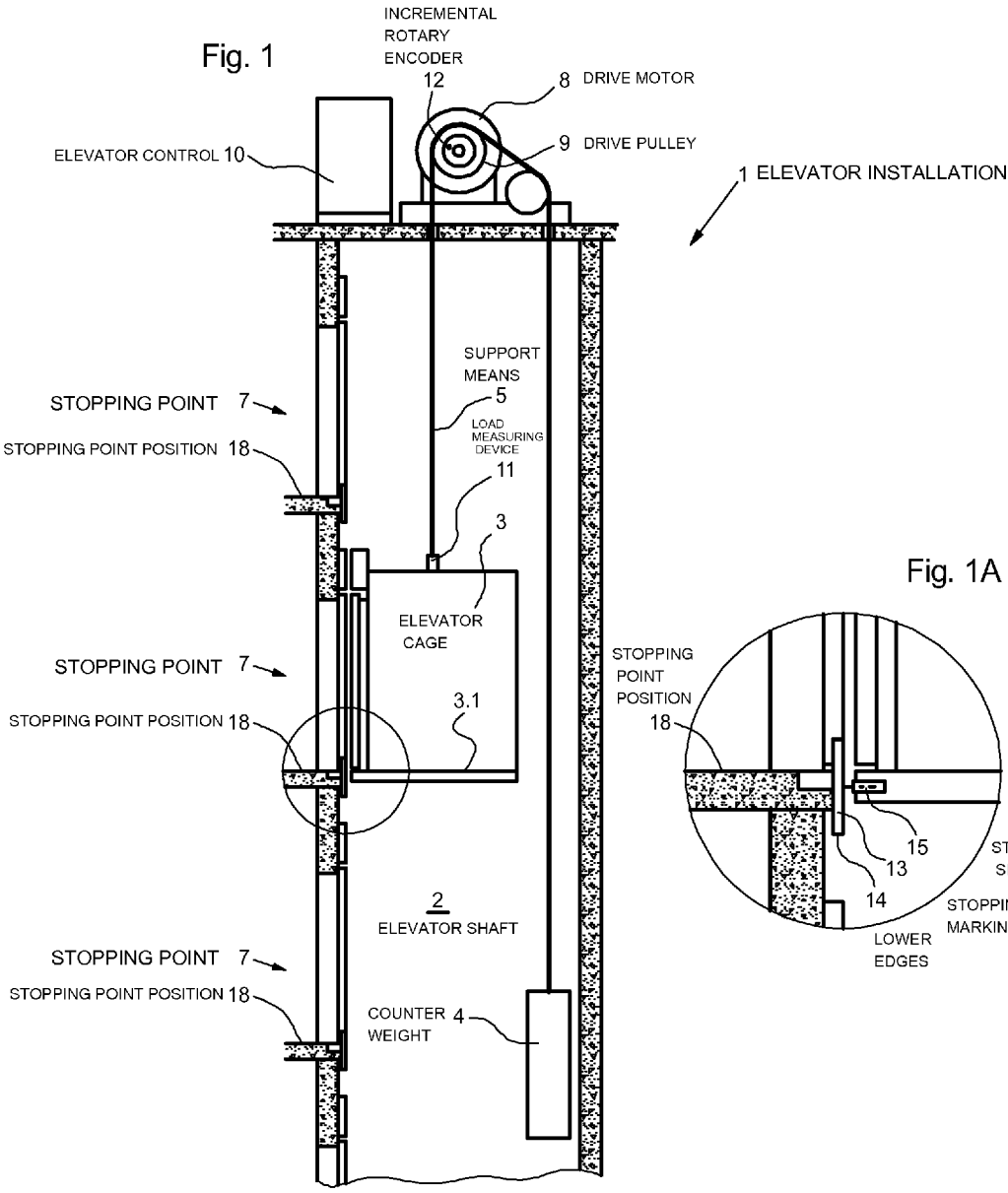
FIG. 1 shows a schematic cross-section through an elevator installation, which is suitable for the use of at least some embodiments of the method.

An elevator installation 1, which can be used with at least some of the disclosed embodiments for controlling the drive motor, is illustrated in FIG. 1 schematically and by way of example. The elevator installation essentially comprises an elevator shaft 2, in which an elevator cage 3 and a counterweight 4 are suspended at support means 5. The elevator cage 3 and the counterweight 4 are movable upwardly and downwardly along a vertical travel path by the support means and can be stopped at a plurality of stopping points 7. The drive force for movement of the elevator cage 3 and the counterweight 4 is produced by a drive motor 8 and transmitted to the support means 5 by way of a drive pulley 9 and to the elevator cage and the counterweight by the support means. An elevator control 10 controls and monitors the functions of the elevator installation 1. A load measuring device supplying information to the elevator control 10 about the magnitude of cage loading instantaneously present in the elevator cage 3 is denoted by the reference number 11.

The elevator shaft has several shaft accesses, which are usually each associated with a respective story of a building and which are termed stopping points 7. In operation of the elevator installation the elevator cage 3 is moved by the drive motor 8 in each instance from an instantaneous elevator cage position—usually from a stopping point position 18 associated with a stopping point 7—at which the elevator cage is instantaneously disposed to a stopping point position 18 associated with another stopping point 7. In that case the rotational movement of the drive motor 8 is controlled or regulated by an elevator control 10 in such a manner that a journey of the elevator cage 3 is performed in, for example, the shortest possible time, i.e. requires a smallest possible journey time. This is achieved in that the elevator control 10 before each travel of the elevator cage 3 calculates a suitable trip/speed profile for the journey to be performed. An optimum plot of this trip/speed profile can be on the one hand dependent on invariable technical specifics such as permissible acceleration, permissible deceleration and maximum speed and on the other hand on situation-dependent influencing factors. In at least some embodiments, the most important situation-dependent influencing factor is the length of the journey of the elevator cage to be carried out, i.e. the distance between the start stopping point and the destination stopping point or between the instantaneous elevator cage position and the destination stopping point position. In addition, the current cage loading could enter into the calculation of the trip/speed profile as, for example, a situation-dependent influencing factor.

In order to be able to realize a movement of the elevator cage 3 in accordance with the calculated trip/speed profile, the rotational speed of the drive motor 8 can regulated by means of a regulating device belonging to the elevator control 10. In order to be able to operate this regulating device as a closed regulating circuit, a movement sensor is sometimes required for reporting the movement data of the drive motor to the regulating device. In the present exemplifying embodiment such a movement sensor is present in the form of an incremental rotary encoder 12 coupled with the motor shaft of the drive motor 8 or with the drive pulley 9.

Moreover, mounted on the elevator cage 3 is a stopping point sensor 15, which, in the case of traveling past or stopping at one of the stopping points 7, the start of a stopping point marking 13 associated with the respective stopping point is detected. The stopping point markings 13 and the stopping point sensor 15 are so positioned that the elevator cage 3 is disposed at the stopping point position associated with the respective stopping point 7, i.e. at a position in which the floor of the elevator cage and the floor of the stopping point lie at the same level, after the elevator cage has been moved in upward travel or downward travel—following detection of the start of the associated stopping point marking 13 as considered in travel direction—additionally by half the known length of the stopping point marking 13. Insofar as this condition is fulfilled, the arrangement of the stopping point sensor 15 in vertical direction at the elevator cage 3 can be freely selected.

Figure 2:
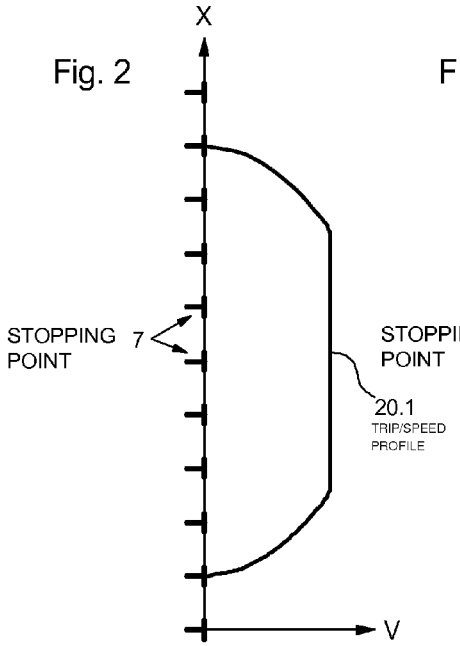
FIG. 2 shows an exemplary trip/speed profile, which is calculated according to an embodiments of the method, for travel of the elevator cage over a relatively large distance.
Figure 3:
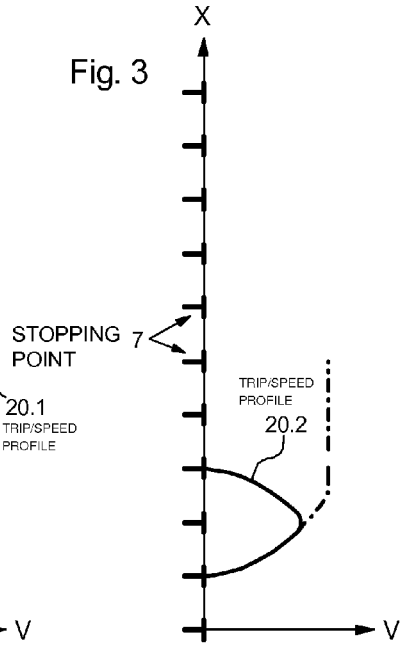
FIG. 3 shows an exemplary trip/speed profile, which is calculated according to the method, for travel of the elevator cage over a relatively small distance.

FIGS. 2 and 3 schematically show trip/speed profiles 20.1, 20.2 for journeys of the elevator cage. The X co-ordinates of the travel distance of the elevator cage and the V co-ordinates of the travel speed, which is dependent on the stated travel distance, of the elevator cage are respectively associated in an X/V co-ordinate system. Symbolic stopping points 7 of the elevator installation are respectively recorded on the X co-ordinate.

A trip/speed profile 20.1 of a journey of the elevator cage 3 over a relatively large travel distance is illustrated in FIG. 2. For a given acceleration, given deceleration and given maximum speed of the elevator cage a trip/speed profile is calculated and activated, in which the elevator cage after an acceleration phase attains a maximum speed, this is kept constant over a specific travel distance until the start of a deceleration phase and then transforms into a deceleration phase with constant deceleration. The trip/speed profile is calculated so that at the end of the deceleration phase the elevator cage will have stopped at the destination stopping point position if no disturbing influences, such as slip in the drive system or, for example, changes in the distances between the stopping points as a consequence of building contraction, have arisen.

An exemplary trip/speed profile 20.2 of a journey of the elevator cage 3 over a relatively short travel distance is illustrated in FIG. 3. For a given acceleration, given deceleration and given maximum speed of elevator cage, a trip/speed profile therefor is calculated and activated, in which the travel speed of the elevator cage cannot reach its maximum, but passes directly from the acceleration phase to the deceleration phase. The trip/speed profile is also calculated for these short travel distances in such a manner that at the end of the deceleration phase the elevator cage will have stopped at the destination stopping point position if no disturbing influences such as slip between the drive pulley 9 and the support means 5 or long-term changes in the spacings between the stopping points 7 as a consequence of building contraction have arisen.

It can be possible to derive from the signals of the incremental rotary encoder 12 at any time not only the movement data of the drive motor 8 and the drive pulley 9, but theoretically also the movement data of the support means 5 and thus of the elevator cage 3. In particular, the elevator control 10 can ascertain and register the instantaneous elevator cage position by evaluation of the signals of the incremental encoder 12 and summation of the travel distances derived therefrom. In the following, the instantaneous elevator cage position registered in the elevator control is termed "instantaneous registered elevator cage position". In fact, however, the transmission of movement from the drive pulley 9 to the support means 5 and thus to the elevator cage 3 is subject to slip, wherein the magnitude of this slip is dependent on the cage loading present during a journey and on friction values, which change with time, between the drive pulley and the support means. However, the coupling of the movement of the incremental rotary encoder with the movement of the elevator cage is thus also subject to slip. Without corrective measures, impermissibly large deviations of the instantaneously registered elevator cage position from the actual instantaneous position of the elevator cage 3 would arise during operation of the elevator installation as a consequence of this slip.

Figure 1A:
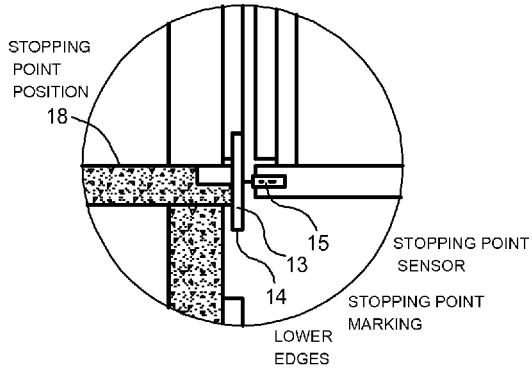
FIG. 1A shows a detail, to enlarged scale, from FIG. 1 with exemplary details of the equipment for detection of the stopping point positions.
Figure 4:
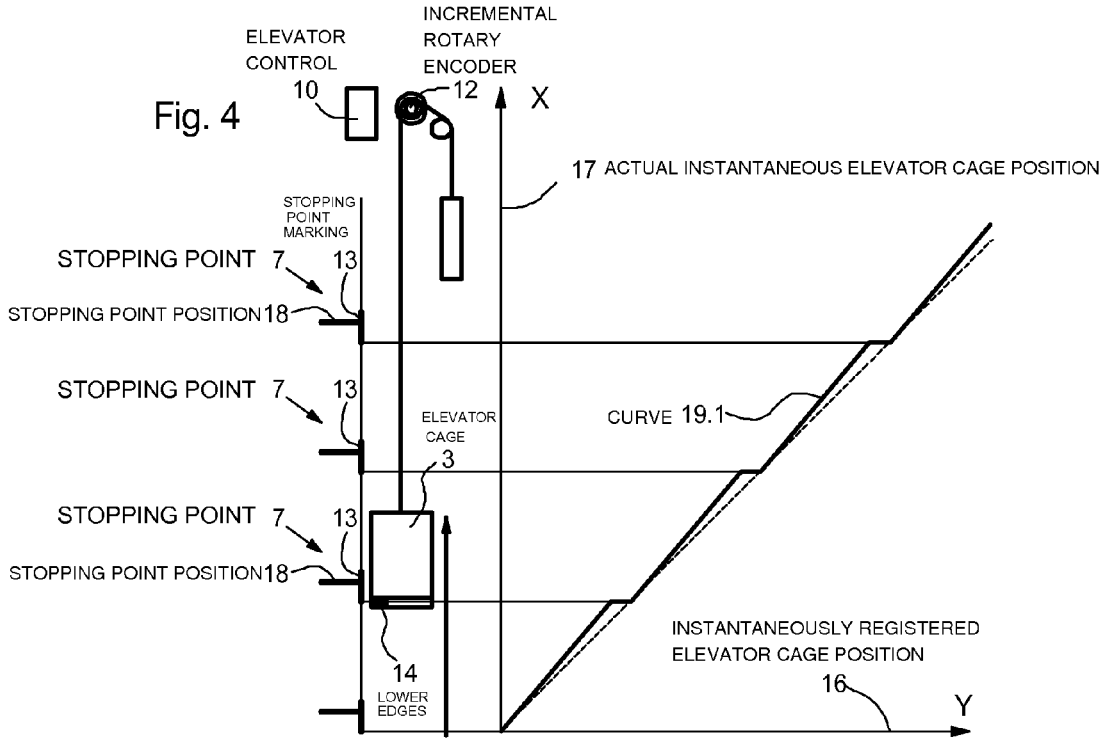
FIGS. 4 and 5 show examples of how the elevator cage position, instantaneously registered in the elevator control, is periodically adapted to the actual instantaneous elevator cage position.
Figure 5:
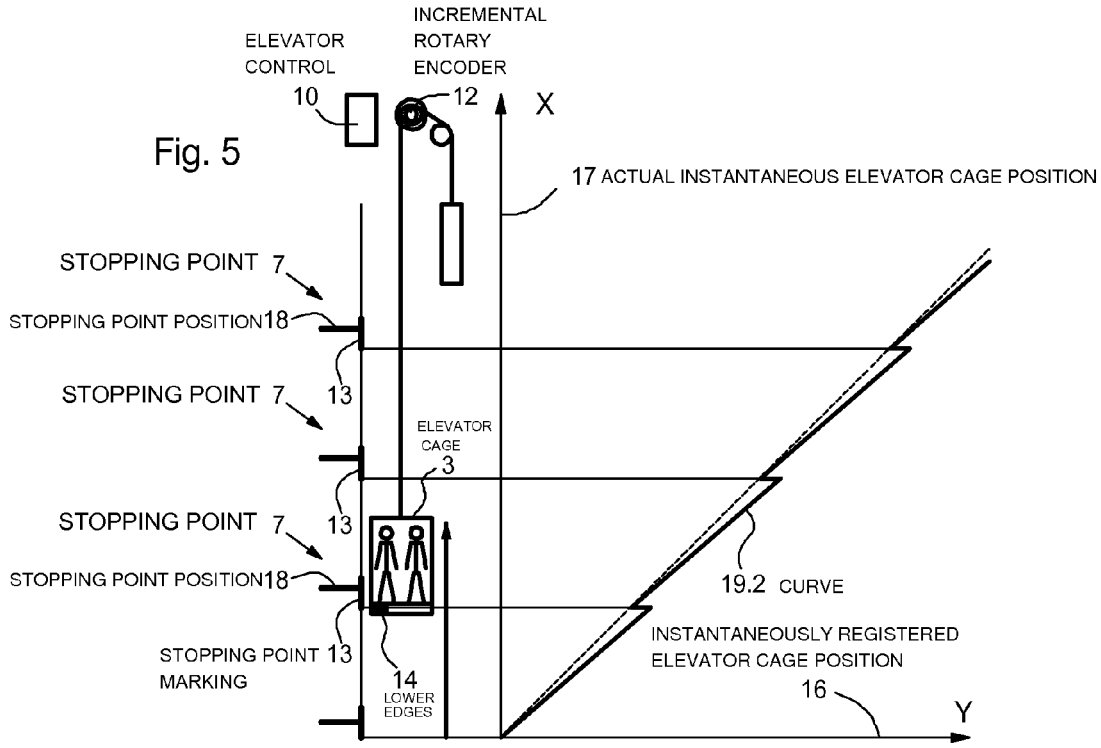

A first exemplary measure for avoidance of impermissibly large deviations between the instantaneously registered and the actual instantaneous elevator cage position is explained on the basis of FIGS. 4 and 5. FIGS. 4 and 5 schematically show the elevator installation according to FIG. 1A, wherein the elevator cage 3 is moved upward direction on each occasion past the stopping points 7. In the illustration according to FIG. 4 the elevator cage 3 has a small cage loading, so that the counterweight 4 is heavier than the total weight of the elevator cage. In the illustration according to FIG. 5 the elevator cage 3 has a relatively high cage loading, so that the total weight of the elevator cage is heavier than the counterweight 4. The actual instantaneous elevator cage position 17 is recorded each time in an X/Y co-ordinate system on the X co-ordinate and the instantaneously registered elevator cage position 16 on the Y co-ordinate. The stopping point positions of the stopping points 7 are marked by the reference numerals 18. The curves 19.1, 19.2 show a usual course of the elevator cage position 16, which is instantaneously registered in the elevator control, in dependence on the actual instantaneous elevator cage position 17. The instantaneously registered elevator cage position 16 can be ascertained on the one hand from the signals of the incremental rotary transmitter 12 and on the other hand is corrected, in correspondence with the first measure described in the following, during the travel of the elevator cage 3 on the basis of the known stopping point position values, which were possibly ascertained in a learning trip, of the respective stopping points 7.

This first measure thus includes correcting the elevator cage position 16, which is instantaneously registered in the elevator control 10, on each movement of the elevator cage past one of the stopping points 7 in that the known stopping point position value, which is stored in the elevator control 10, of the respective stopping point is registered as a new instantaneously registered elevator cage position 16. For this purpose all stopping points 7 are provided with a respective stopping point marking 13, wherein all stopping point markings have a uniform length as considered in travel direction of the elevator cage and are arranged at the same level relative to the respectively associated stopping points 7. The stopping point sensor 15 mounted on the elevator cage 3 detects, during travel past or stopping at a stopping point, the respective start of the associated stopping point marking 13. This situation is illustrated in FIGS. 4 and 5. As already explained in the foregoing, the stopping point markings 13 and the stopping point sensors 15 are so positioned that the elevator cage 3 is disposed in a stopping point position associated with the respective stopping point 7 after the elevator cage in upward travel or downward travel following detection of the start, as considered in travel direction, of the associated stopping point marking 13 has been moved on by the known half-length of the stopping point marking. In the case of each movement past one of the stopping points 7 the elevator cage position 16 instantaneously registered in the elevator control is, when the start of the stopping point marking 13 associated with this stopping point is detected, corrected in correspondence with a stopping point position value registered in the elevator control for the respective stopping point 7 and preferably detected in a learning trip. In that case, for ascertaining the instantaneously registered elevator cage position 16 on detection of the start of the stopping point marking 13, the spacing, which corresponds with half the length of the stopping point marking and is still present, from the stopping point position in the case of upward travel, i.e. a positive travel direction, is subtracted from the known stopping point position value and is added in the case of downward travel. In the case of further travel, starting from the respective corrected instantaneously registered elevator cage position, the change in the instantaneously registered elevator cage position is registered on the basis of the signals of the incremental rotary encoder 12 until the destination stopping point position is reached or a new correction takes place.

Alternatively, instead of detection of the start, as considered in travel direction of the elevator cage, a stopping point marking the end thereof can be detected. In order to ascertain the instantaneously registered elevator cage position 16, in this case the spacing, which corresponds with half the length of the stopping point marking 13, from the associated stopping point position in upward travel, i.e. in positive travel direction, is to be added to the known stopping point position value and to be subtracted therefrom in the case of downward travel.

In the situation shown in FIG. 4 the weight of the elevator cage 4 is greater than the total weight of the elevator cage 3 with small loading, so that when there is upward travel of the elevator cage a negative slip between support means 5 and drive pulley 9 results, i.e. a slip of the traction means relative to the traction surface of the drive pulley in the direction of movement of the traction surface. Such a negative slip has the consequence that the instantaneously registered elevator cage position 16 ascertained from the signals of the incremental rotary encoder has with increasing travel distance in upward direction a constantly increasing negative deviation from the actual instantaneous elevator cage position. It can be seen from the curve 19.1 in FIG. 4 that in each instance on detection of one of the stopping point markings 13, the instantaneously registered elevator cage position is, as described in the foregoing, corrected in correspondence with the known stopping point position value, i.e. increased in the case of the situation shown in FIG. 4.

In the situation shown in FIG. 5 the weight of the counterweight 4 is less than the total weight of the strongly loaded elevator cage 3, so that on upward travel of the elevator cage a positive slip between support means 5 and drive pulley 9 results, i.e. a slip of the support means relative to the traction surface of the drive pulley which is opposite to the movement of this traction surface. Such a positive slip has the consequence that the instantaneously registered elevator cage position 18, ascertained from the signals of the incremental rotary encoder, has, with increasing travel distance in upward direction, a constantly growing positive deviation from the actual instantaneous elevator cage position. It can be seen from the curve 19.2 in FIG. 5 that in each instance when one of the stopping point markings 13 is detected, the instantaneously registered elevator cage position 16 is, as described in the foregoing, corrected in correspondence with the known stopping point position value, i.e. for the situation shown in FIG. 5.

After (e.g., directly after) correction of the instantaneously registered elevator cage position 16 has been carried out, the trip/speed profile 20.1, 20.2 (FIGS. 2, 3) is recalculated in correspondence with the corrected instantaneously registered elevator cage position for the remaining residual distance of the travel of the elevator cage up to the destination stopping point position and activated. It is thus achieved that the stopping point marking 13 of the destination stopping point is reached at scheduled travel speed, whereby it is ensured that braking of the elevator cage 3, until reaching the destination stopping point position 18, can be carried out at the intended rate of deceleration and in the shortest possible time.

Such a correction of the instantaneously registered elevator cage position 16 by appropriate adaptation of the trip/speed profile for the remaining residual distance for travel of the elevator cage to the destination stopping point position 18 usually takes place during travel past each intermediate stopping point. Alternatively, such an adaptation can be additionally carried out on reaching the start of the stopping point marking 13 of the destination stopping point.

In a further alternative embodiment, in each instance on detection of a start, as considered in travel direction of the elevator cage, of a stopping point marking 13 the aforedescribed correction of the stopping point position value can be undertaken, and in the case of subsequent detection of the end of the stopping point marking 13 the remaining residual distance of the travel of the elevator cage 3 to the destination stopping point position, as well as the trip/speed profile 20.1, 20.2 corresponding with this residual distance, can be recalculated and activated.

Figure 6:
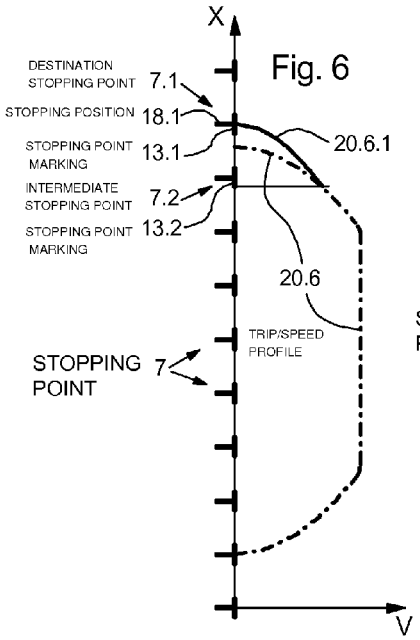
FIG. 6 shows an exemplary calculated trip/speed profile with a path-lengthening correction in the case of travel of the elevator cage past the stopping point lying in front of the destination stopping point.
Figure 7:
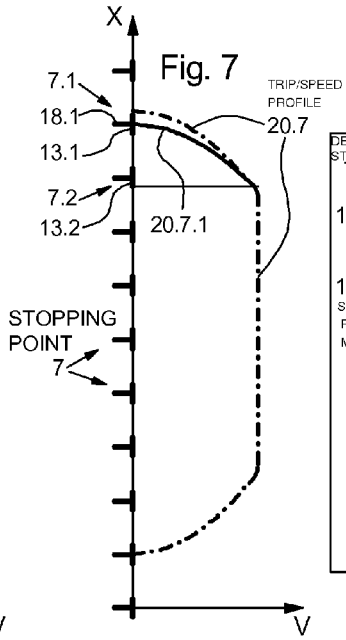
FIG. 7 shows an exemplary calculated trip/speed profile with a path-shortening correction in the case of travel of the elevator cage past the stopping point lying in front of the destination stopping point.
Figure 8:
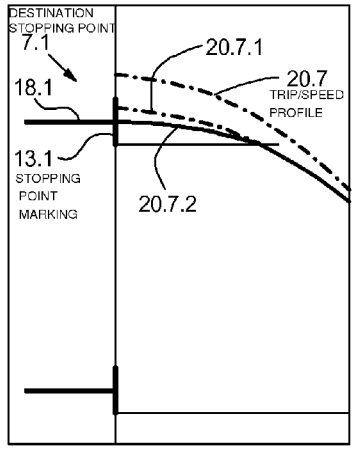
FIG. 8 shows an exemplary path/speed profile as in FIG. 7, but with additional path-shortening correction for the arrival of the elevator cage at the destination stopping point.

It is explained in the following on the basis of FIGS. 6, 7 and 8 what is to be understood by adaptation or correction of the active trip/speed profile 20 during travel of the elevator cage 13. As already described in the foregoing in connection with FIGS. 2 and 3, exemplary trip/speed profiles are also illustrated in FIGS. 6, 7 and 8 in X/V co-ordinate systems. In that case the X co-ordinate is associated with the travel distance of the elevator cage and the V co-ordinate with the travel speed—which is dependent on the stated travel distance—of the elevator cage. The stopping points 7 of the elevator installation are recorded symbolically on the X co-ordinate.

FIG. 6 shows a plot of the travel speed of the elevator cage or a speed profile for such a journey over several stopping points 7. On the basis of the trip/speed profile 20.6, which was active before reaching the stopping point marking 13.2 of the last intermediate stopping point 7.2 and which is illustrated as a dot-dashed line, the elevator cage 3 as a consequence of positive slip in the coupling between the movement of the elevator cage 3 and the incremental rotary encoder 12 (FIG. 1) coupled with the drive motor did not even reach the stopping point marking 13.1 of the destination stopping point 7.1 or reached it at a too slow travel speed. This would have the consequence of at least an increased travel time, since the elevator cage at the end of the travel would have had to have covered a relatively large distance at significantly reduced speed. In the case of relatively large deviations of the instantaneously registered elevator cage position from the actual instantaneous position of the elevator cage, a shutdown of the elevator installation could even result in this situation. However, on detection of the stopping point marking 13.2 of the intermediate stop 7.2 lying ahead of the destination stopping point 7.1, the actual remaining residual distance for travel of the elevator cage 3 to the destination stopping point 18.1 is calculated by the elevator control 10 from the known stopping point position values of the intermediate stopping point 7.2 and the destination stopping point 7.1 and on the basis of this residual distance a new, corrected trip/speed profile 20.6.1 is calculated and activated, which is illustrated in FIG. 6 as a solid line. The recalculated and activated trip/speed profile can have the effect that the elevator cage 3 reaches the stopping point marking 13.1 of the destination stopping point 7.1 at scheduled travel speed, so that it can be ensured that the braking of the elevator cage, within the travel distance between detection of the stopping point marking 13.1 of the destination stopping point 7.1, and reaching the destination stopping point position 18.1 can take place at the intended deceleration and in the intended and possibly optimized time.

FIG. 7 shows, like FIG. 6, a plot of the travel speed of the elevator cage 3 over several stopping points 7. On the basis of the trip/speed profile 20.7, active before reaching the stopping point marking 13.2 of the last intermediate stopping point 7.2 and illustrated as a dot-dashed line, the elevator cage would reach the stopping point marking 13.1 of the destination stopping point 7.1 at too high travel speed as a consequence here of negative slip in the coupling between the movement of the elevator cage and the incremental rotary encoder 12 coupled with the drive motor 8. This would have the consequence that, in the case of relatively large deviations of the instantaneously registered elevator cage position from the actual instantaneous position of the elevator cage, a stopping of the elevator cage at the destination stopping point 7.1 with permissible deceleration would no longer be possible, which would lead to over-travel of the destination stopping point position and to shutdown of the elevator installation. However, on detection of the stopping point marking 13.2 of the intermediate stopping point 7.2 lying ahead of the destination stopping point 7.1, the actual remaining residual distance for travel of the elevator cage 3 to the stopping point position of the destination stopping point 7.1 is also calculated, in this case by the elevator control 10 from the known stopping point position values of the intermediate stopping point 7.2 and the destination stopping point 7.1, and on the basis of this residual distance a new, corrected travel-speed profile 20.7.1 is calculated and activated, which is illustrated in FIG. 7 as a solid line. The newly calculated and activated trip/speed profile 20.7.1 also has the effect in this case that the elevator cage reaches the stopping point marking 13.1 of the destination stopping point 7.1 at scheduled travel speed so that braking of the elevator cage within the travel distance between the detection of the stopping point marking 13.1 of the destination stopping point 7.1 and reaching the stopping point position 18.1 of the destination point 7.1 can take place at the intended rate of deceleration.

In the case of usual plots of the travel speed, such as illustrated in FIG. 6 and FIG. 7, in the case of each detection of a stopping point marking 13 of one of the intermediate stopping points 7, a new trip/speed profile 20 is calculated on the basis of the actually remaining residual distance and activated. This is intentionally not shown in FIGS. 6 and 7, since (at least in these embodiments) in the case of an even larger spacing of the elevator cage from the destination stopping point the corrections of the trip/speed profile are still so small that they would be hardly recognizable.

FIG. 8 shows in enlarged illustration an end region of a trip/speed profile based on the trip/speed profile 20.7.1 illustrated in FIG. 7. However, a modified embodiment of the method can be seen in FIG. 8. In this embodiment, on detection of the stopping point marking 13.1 of the destination stopping point 7.1 a new, corrected trip/speed profile 20.7.2 for the remaining residual distance between the position of the detection of the stopping point marking of the destination stopping point and the destination stopping point position is again calculated and activated. This new, corrected trip/speed profile 20.7.2 connects with the trip/speed profile 20.7.1 already corrected in accordance with FIG. 7 relative to the original trip/speed profile 20.7. An additionally improved stopping accuracy at the destination stopping point position 18.1 can be achieved on the basis of the modification illustrated by FIG. 8.

A further exemplary measure for avoidance of impermissibly large deviations between the instantaneously registered and the actual elevator cage position is explained in the following. The slip between the drive pulley 9 and the support means 5, which is to be anticipated during travel, is calculated into the calculation of a trip/speed profile 20.1, 20.2, 20.6, 20.7, which is described by FIGS. 2, 3, 6, 7 and 8, for a journey of the elevator cage from a start position to a destination stopping point or in the case of recalculation of a trip/speed profile when the elevator cage 3 travels past a stopping point 7 lying between the start position and the destination stopping point position. This possibly takes place by the travel distance, which is calculated by the elevator control 10 on the basis of the known stopping point positions, between a start position of the elevator cage and the destination stopping position or a calculated remaining residual distance between an intermediate stopping point and the destination stopping point being multiplied by a slip factor and subsequently on the basis of this slip-corrected travel distance or residual distance a trip/speed profile 20 for travel until reaching the destination point stopping position being calculated and activated.

The slip, which arises between the drive pulley 9 and the support means 5 during travel of the elevator cage 3, can be strongly dependent on the cage loading by passengers or freight during the journey. A further measure for avoidance of impermissibly large deviations between the instantaneously registered and the actual elevator cage position consists in that the afore-described slip correction is carried out in the manner that the calculated travel distance between the instantaneous elevator cage position and the destination stopping point position or the calculated remaining residual distance to the destination stopping point position is multiplied by a load-dependent slip factor $f_{S/b}$. Such load-dependent slip factors can be stored in a table memory of the elevator control in association with a respective one of a plurality of cage loading ranges. For carrying out a slip correction as described in the foregoing a load-dependent slip factor $f_{S/b}$ is, on the basis of a measurement of the instantaneously present cage loading, read out of a column, which is associated with the corresponding cage loading range, of the table memory. Information about the respective instantaneously present cage loading is supplied by a load measuring device 11 (FIG. 1) to the elevator control 10.

Load-dependent slip factors $f_{S/b}$ correspond with the ratio between the travel distance detected for a specific journey of the elevator cage 3 by the incremental rotary encoder via a coupling liable to slip and the actual travel distance calculated on the basis of the known positions of the stopping point markings 13. In the course of normal operation of the elevator installation they can be ascertained in accordance with a method described in the following. This method is based on the concept of ascertaining, in each of several journeys of the elevator cage with cage loading of similar size, the slip factors which in that case have actually arisen and which are termed actual value slip factors in the following, forming a mean value therefrom and making this mean value available as a load-dependent slip factor $f_{Sb}$, which applies to the respective cage loading range, for calculation of trip/speed profiles. Such an actual value slip factor is possibly ascertained after each trip of the elevator cage 3. For this purpose a first value is registered for the travel distance detected on the basis of the signals of the incremental rotary encoder 12 during travel between the end of the stopping point marking of the start stopping point and the start of the stopping point marking of the destination stopping point. Moreover, a second value for the stated travel distance is calculated by the elevator control from the registered stopping point position values of the start stopping point and the destination stopping point with consideration of the defined length of the stopping point markings. The quotient of the first and second values is then stored as actual value slip factor in association with that cage loading range which can be assigned to the cage loading present in the evaluated travel. The storage can take place dynamically, i.e. a number of successively detected actual value slip factors is stored according to the first in-first out principle in columns of a table memory, wherein each column is associated with one of a plurality of cage loading ranges. For each of the table columns, i.e. for each cage loading range, a mean value of the actual value slip factors stored therein is periodically calculated. These mean values are then available as information for calculation of a trip/speed profile 20 for movement of the elevator cage from an instantaneous position of the elevator cage until reaching a destination stopping point, with a specific cage loading.

The value of the ascertained actual value slip factors can be greater or smaller than 1 depending on the respective combination of cage loading and travel direction. In the case of upward journeys of the elevator cage the actual value slip factor is greater than 1 when the total weight of the elevator cage is greater than the weight of the counterweight, and smaller than 1 when the total weight of the elevator cage is smaller than the weight of the counterweight. In the case of downward journeys the ratios are reversed, i.e. in downward journeys actual value slip factors arise having values corresponding with the reciprocal values of the actual value slip factors resulting in the case of upward journeys with the same weight ratios. If the ascertained actual value slip factors are stored only in association with cage loading ranges and not additionally with travel direction, then the reciprocal values of the ascertained measurement values are to be registered for one of the travel directions. In the case of correction of the remaining residual distances or the corresponding trip/speed profiles, the reciprocal values of the load-dependent slip factors $f_{S/b}$ extracted from the table memory are again to be used for this travel direction. The use of reciprocal values can be avoided if the ascertained actual value slip factors in the case of storage are associated not only with different cage loading ranges, but additionally with the travel directions in which they were ascertained.

In the previous explanations it was assumed that the stopping point position values of all stopping points 7 and thus the position values of the stopping point markings 13 associated therewith are known to the elevator control. However, these data have to be input into the elevator control when the elevator installation is placed in operation. This is possibly carried out in that the elevator control is caused to allow the elevator cage 3 to execute a learning trip which comprises an upward learning trip and a downward learning trip. The learning trip extends over all stopping points 7 and the stopping point markings 13 associated with these stopping points and correctly leveled relative thereto. The upward learning trip of the elevator cage 3 possibly begins from a position lying somewhat below the lowermost stopping point. During the upward learning trip the elevator control 10 continuously detects the instantaneous position of the elevator cage 3 on the basis of the signals of the incremental rotary encoder 12 and in the case of travel of the elevator cage past the stopping point markings 13 the stopping point sensor 15 mounted on the elevator cage 3 detects the starts or the lower edges 14 of these stopping point markings. On detection of the lower edge 14.1 (FIG. 9) of the stopping point marking 13.1 of the lowermost stopping point the elevator control sets the position value of the position detection system to zero and assigns the lowermost stopping point to a position value, which is increased by half the length of the stopping point marking, as stopping point position value. In the further course of the upward learning trip the elevator control 10 assigns the respective instantaneously registered elevator cage position to each of the detected lower edges of all stopping point markings 10, calculates the stopping point position values of all stopping points 7 with inclusion of the known half vertical length of the stopping point markings 13, and registers these in a data memory.

In another embodiment of the method the learning trip can additionally serve the purpose of checking or correcting the value of the drive pulley diameter, which is input into the elevator control before placing the elevator installation into operation. This checking or correction takes place in the case of over-travel of a stopping point marking by a comparison of the distance, which is detected on the basis of the signals of the stopping point sensor 15 and the incremental rotary encoder 12, between start and end of the stopping point marking with the precisely known length of the stopping point marking.

As already mentioned, the coupling between the movement of the elevator cage 3 and the incremental rotary encoder 12 detecting this movement is realized by way of the support means 5 and the drive pulley 9. In the case of detection of the instantaneous position of the elevator cage during the upward learning trip and thus in the case of the association, which takes place then, of the stopping point position values with the stopping points 7, deviations therefore arise between the stopping point position values detected on the basis of the signals of the incremental rotary encoder 12 and the actual stopping point position values, which deviations are caused by the slip arising between the support means and the drive pulley.

Figure 9:
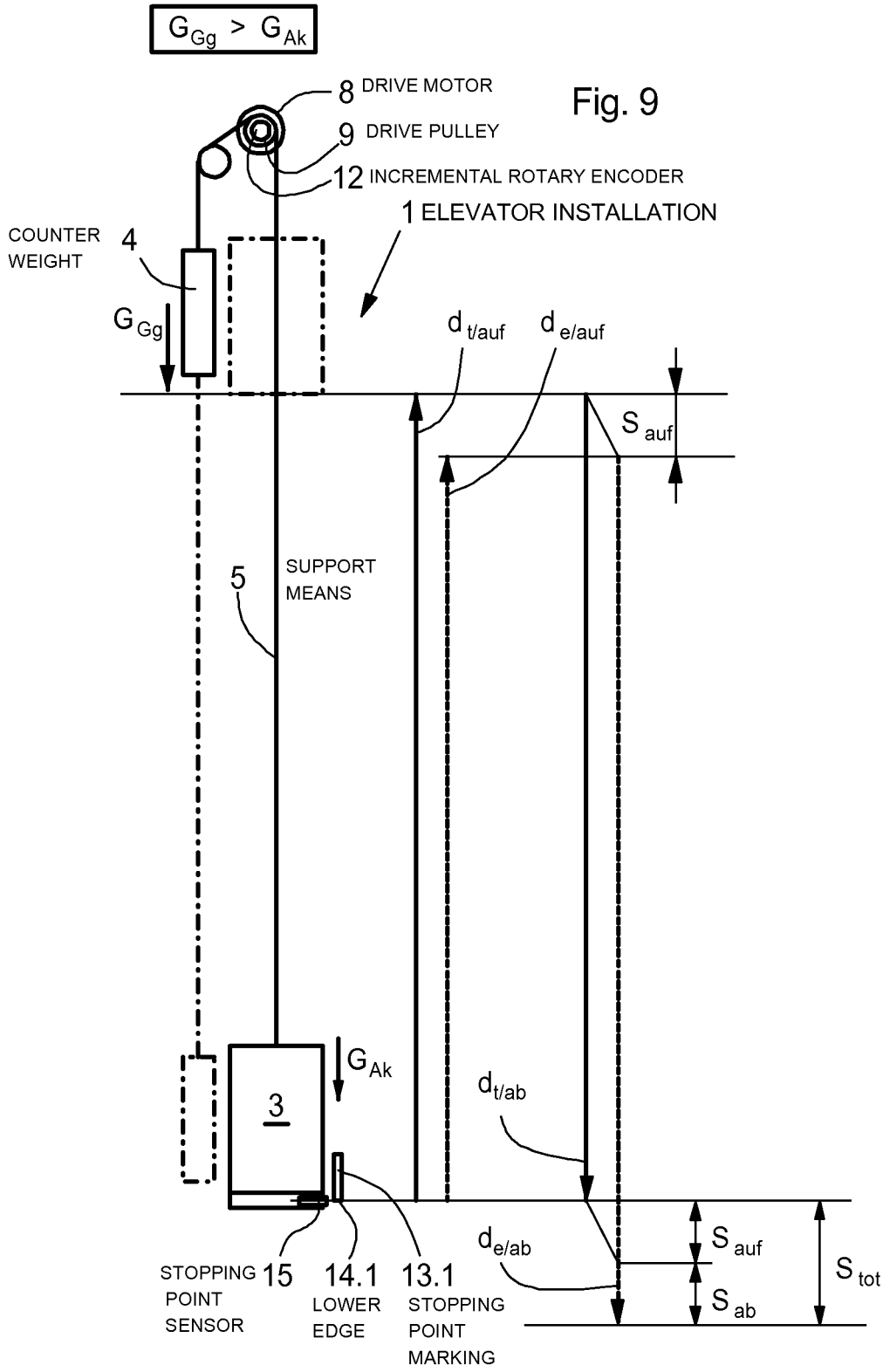
FIG. 9 shows an illustration of an exemplary learning trip for ascertaining the stopping point position and the derivation of a learning trip factor and FIG. 10 shows a flow chart of an exemplary embodiment of the method.

By way of FIG. 9 it is explained how the stopping point position values detected under the influence of the slip can be corrected, in that in the case of the learning trip a learning trip slip factor $f_{S/b}$ is ascertained by which the stopping point position values detected during the learning trip are subsequently corrected. The elevator installation 1 according to FIG. 1 is schematically illustrated in FIG. 9, which installation comprises the elevator cage 3, the counterweight 4, the drive motor 8 with the drive pulley 9 and the support means 5 driven by the drive motor via the drive pulley and supporting the elevator cage as well as the counterweight. The incremental rotary encoder 12 detects the rotational movement of the drive pulley 9 and thus substantially the movement of the elevator cage 3.

Since the weight $G_{Gg}$ of the counterweight 4 is greater than the weight $G_{Ak}$ of the empty elevator cage, in the case of the upward learning trip of the elevator cage a negative slip between the support means 5 and the drive pulley 9 results. This can mean that the upward travel distance $D_{e/auf}$ detected by the incremental rotary encoder 12 is less than the actual travel distance $D_{t/auf}$ of the elevator cage. In the subsequent downward learning trip of the elevator cage a positive slip results, since the traction force to the transmitted by the drive pulley 9 to the support means 5 acts in the direction of the movement. This has the consequence that the downward travel distance $d_{e/ab}$ detected by means of the incremental rotary encoder 12 is greater than the actual downward travel distance $d_{t/ab}$.

The correction method proposed here is based on the recognition that in the case of a learning trip, which comprises an upward learning trip and a subsequent downward learning trip, with empty or lightly loaded elevator cage a difference results between the upward travel distance $d_{e/auf}$, which is detected from a specific point in the lower elevator region to a reversal position by means of the incremental rotary encoder, and the downward travel distance $d_{e/ab}$ detected from the reversal position to the specific point, and that this difference corresponds with the total slip $S_{tot}$, which is composed of the slip $S_{auf}$ which has arisen in the upward travel and the slip $S_{ab}$ which has arisen in the downward travel.

These relationships are graphically illustrated in FIG. 9. The vector marked by the reference $d_{t/auf}$ represents the actual upward travel distance $d_{t/auf}$, which in the case of the learning trip in upward direction is covered by the elevator cage 3 above the mentioned specific point. The specific point is here defined by the lower edge 14.1 of the stopping point marking 13.1 of the lowermost stopping point, which is detected with the help of the stopping point sensor 15 mounted on the elevator cage 3 and, as described in the foregoing, also serves for determination of the zero position value of the position detection system. With the detection, which takes place in the region of the start of the upward learning trip, of this stopping point marking 13.1 the measurement of the upward travel distance $d_{e/auf}$, which is detected in the upward learning trip by means of the incremental rotary encoder and which is represented by the vector with the reference $d_{e/auf}$, begins. The negative slip, which arises in the upward learning trip, between drive pulley 9 and support means 5 causes a reduction in the rotational movement, which is required for the actual upward travel distance $d_{t/auf}$, of the drive pulley, which has the consequence of a deviation off the upward travel distance $d_{e/auf}$, which is detected by means of the incremental rotary encoder, relative to the actual upward travel distance $d_{t/auf}$, this deviation being termed slip $S_{auf}$. In the subsequent downward learning trip the reduction of the detected position value, i.e. the backward counting of the counter state of the position detecting system, therefore begins already at a position value reduced by comparison with the actual travel distance $d_f$ by the slip $S_{auf}$. The positive slip, which arises in the downward learning trip, between drive pulley 9 and support means 5 produces an increase in the rotational movement, which is required for the actual downward travel distance $d_{t/ab}$, of the drive pulley 9, which has the consequence of a deviation of the downward travel distance $d_{e/ab}$, which is detected by means of the incremental rotary encoder relative to the actual downward travel distance $d_{t/ab}$, this deviation being termed slip $S_{ab}$.

If the elevator cage 3 in the downward learning trip has now reached the specific point at which in the case of the upward learning trip the measurement of the detected upward travel distance $d_{e/auf}$ was commenced with the position value '0', then the position value, which was detected at the specific point, or the counter state of the position detecting system, will have reached a value which lies in the negative region by the sum, which is termed total slip $S_{tot}$, of the two slip values $S_{auf}$ and $S_{ab}$ and corresponds with the difference of the detected downward travel distance $d_{e/ab}$ and the detected upward travel distance $d_{e/auf}$.

As illustrated in FIG. 9, it is possible to derive from these recognitions a learning trip slip factor $f_{S/L}$ by which the stopping point position values, which were detected in the upward learning trip and registered in the elevator control after the learning trip has been concluded, of all stopping points are multiplied, i.e. corrected. The derivation of this learning trip slip factor proceeds from the recognition that this learning trip slip factor $f_{S/L}$ has to represent the ratio between the actual upward travel distance $d_{t/auf}$ and the upward travel distance $d_{e/auf}$ detected by means of the incremental rotary encoder, which is expressed by the formula $$f_{S/L} = \frac{d_{t/auf}}{d_{e/auf}}$$

With the assumption that the slip in the case of upward travel is of the same magnitude as the slip in the downward travel, the learning trip slip factor $f_{S/L}$ can be derived therefrom as follows:

$$f_{S/L} = \frac{d_{t/auf}}{d_{e/auf}} = \frac{d_{e/auf} + S_{auf}}{d_{e/auf}} \text{ wherein } S_{auf} = \frac{d_{e/ab} - d_{e/auf}}{2}$$

-continued $$f_{S/L} = \frac{d_{e/auf} + \frac{d_{e/ab} - d_{e/auf}}{2}}{d_{e/auf}} = \frac{2d_{e/auf} + d_{e/ab} - d_{e/auf}}{2d_{e/auf}}$$

$$f_{S/L} = \frac{d_{e/auf} + d_{e/ab}}{2d_{e/auf}}$$

$f_{S/L}$=learning trip slip factor
$d_{t/auf}$=actual upward travel distance
$d_{t/ab}$=actual downward travel distance
$d_{e/auf}$=detected upward travel distance
$d_{e/ab}$=detected downward travel distance
$S_{auf}$=slip in upward travel
$S_{ab}$=slip in downward travel
$S_{tot}$=total slip It is thus possible to determine the stopping point position values of the stopping points 7 with great accuracy by means of a learning trip although the rotary encoder, which detects the movement of the elevator cage, is coupled with the movement of the elevator cage by way of a connection, namely via the drive pulley and the support means, subject to slip.

Figure 10:
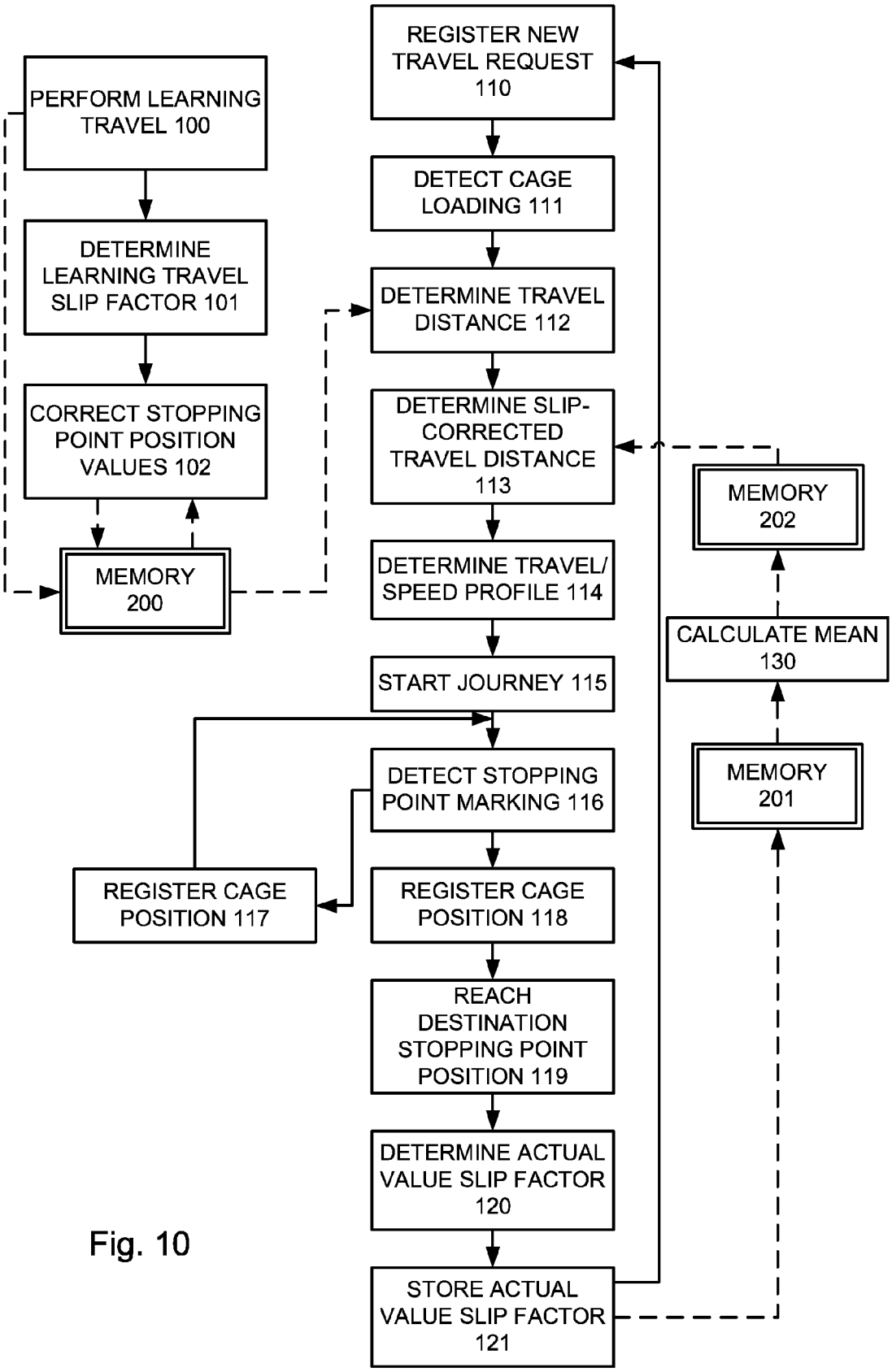

FIG. 10 shows an exemplary embodiment of an overview of the steps of the afore-described method in the form of a flow chart. In this flow chart, transitions between method steps are illustrated by solid lines and closed arrows and the transmission of data is illustrated as dot-dashed lines with open arrows.

In step 100 a learning trip, preferably with an empty elevator cage, is carried out when the elevator installation is placed in operation, wherein the learning trip comprises on each occasion an upward learning trip and a downward learning trip over all stopping points 7. In the case of the upward learning trip the instantaneous position of the elevator cage 3 is continuously detected on the basis of the signals of the rotary encoder 12 and, with each detection of a stopping point marking 13 by the stopping point sensor 15 mounted on the elevator cage 3, the instantaneously registered position, which is increased by half the length of the stopping point marking, of the elevator cage is associated with the respective stopping point as stopping point position value and stored in a table memory 200.

In step 101*a* learning trip slip factor $f_{S/L}$ is ascertained, which serves the purpose of correcting the stopping point position values which are associated with the stopping point 7 in the learning trip and which are subject to slip errors.

In step 102 the stopping point position values associated with the stopping points in the learning trip and stored in the table memory 200 are corrected through multiplication by the ascertained learning value slip factor $f_{S/L}$.

A semiconductor table memory of the elevator control is illustrated by the reference numeral 200, in which the stopping point position values associated during the learning trip with each stopping point and corrected by the learning trip slip factor $f_{S/L}$ are stored so as to be able to be called up.

In step 110 in normal operation of the elevator installation a new travel request with a new destination stopping point is registered in the elevator control.

In step 111 the instantaneous cage loading is detected by the elevator control.

In step 112 the actual travel distance for travel from the instantaneous position of the elevator cage to the destination storey is calculated on the basis of the stopping point position values stored in the table memory 200.

In step 113 a slip-corrected travel distance is calculated from the calculated actual travel distance through multiplication by a load-dependent slip factor $f_{S/b}$ dependent on the instantaneous cage loading and the travel direction.

In step 114 a trip/speed profile for travel of the elevator cage from the instantaneous elevator cage position until reaching the destination stopping point position is calculated on the basis of the calculated slip-corrected travel distance and activated.

In step 115 a journey of the elevator cage is started, wherein the plot of the travel speed is controlled or regulated by the elevator control in correspondence with the calculated trip/speed profile.

In step 116 a stopping point marking is detected by the stopping point sensor mounted on the elevator cage and a decision is made on the basis of the elevator cage position instantaneously registered in the elevator control and the destination stopping point registered for the current journey whether the stopping point associated with the detected stopping point marking is an intermediate stopping point or the destination stopping point.

In step 117, on detection of stopping point markings of intermediate stopping points and on the basis of the registered stopping point position values, on each occasion the elevator cage position instantaneously registered in the elevator control is corrected, the residual distance still to be covered by the elevator cage up to the destination stopping point position is recalculated and corrected by the load-dependent slip factor $f_{S/b}$ corresponding with the instantaneous cage loading and the travel direction, and on the basis of this slip-corrected residual distance a new trip/speed profile for further travel of the elevator cage is calculated and activated.

In step 118, on detection of the stopping point markings of the destination stopping point, the elevator cage position instantaneously registered in the elevator control is corrected, the trip/speed profile is newly calculated on the basis of the residual distance still to be covered by the elevator cage up to the destination stopping point position and is activated, wherein as residual distance the calculation is based on half the length, or half the length corrected by the load-dependent slip factor $f_{S/b}$, of the stopping point marking, and the travel speed is subject to downward regulation in accordance with the newly calculated trip/speed profile until standstill at the destination stopping point position.

In step 119 the destination stopping point position is reached by the elevator cage and the elevator cage is stopped until registration of a new travel request by the elevator control.

In step 120 an actual value slip factor is ascertained after reaching the destination stopping point position in that:

a first value for a defined travel distance between the start stopping point and the destination stopping point is ascertained on the basis of the signals of the rotary encoder, a second value for the defined travel distance is ascertained on the basis of the registered stopping point position values of the start stopping point and the destination stopping point and the actual value slip factor is calculated as the quotient of the first and second values.

In step 121 the calculated actual value slip factor is dynamically stored in a table memory in association with one of a plurality of cage loading ranges, wherein for determination of this association the cage loading present in the respective journey of the elevator cage and preferably also the travel direction are detected by the elevator control.

A semiconductor table memory of the elevator control is illustrated by the reference numeral 201, the memory comprising several table columns which are each associated with a respective cage loading range and a travel direction and in which the actual value slip factors, which are ascertained in normal operation and dependent on the cage loading and the travel direction, are dynamically stored, i.e. according to the first in-first out principle.

In step 130 a mean value is periodically calculated for each of the table columns of the table memory 121 from the actual value slip factors stored in the respective table column and is stored, so as to be capable of being called up, in corresponding table columns of a further table memory 202 as instantaneously usable load-dependent slip factors $f_{S/b}$ each associated with a respective cage loading range and a travel direction.

A semiconductor table memory of the elevator control is illustrated by the reference numeral 202, which comprises several table columns which are each associated with a respective cage loading range and a travel direction and in which the load-dependent slip factors $f_{S/b}$ calculated in step 130 and dependent on the cage loading in the travel direction are stored and able to be called up for correction of the calculated actual travel distance as described in step 113.

Having illustrated and described the principles of the disclosed technologies, it will be apparent to those skilled in the art that the disclosed embodiments can be modified in arrangement and detail without departing from such principles. In view of the many possible embodiments to which the principles of the disclosed technologies can be applied, it should be recognized that the illustrated embodiments are only examples of the technologies and should not be taken as limiting the scope of the invention. Rather, the scope of the invention is defined by the following claims and their equivalents. We therefore claim as our invention all that comes within the scope and spirit of these claims.

We claim:

1. An elevator method, comprising:

determining, for an elevator cage in an elevator installation, a movement profile of the elevator cage for movement of the elevator cage to a destination stopping point position in the elevator installation, the determining being based at least in part on an anticipated slip between a drive pulley and a support coupled to the elevator cage;

detecting a movement of the elevator cage based at least in part on signals of a rotary encoder coupled to the drive pulley or to a drive motor; and during the movement of the elevator cage, controlling the drive motor based at least in part on the signals of the rotary encoder and the movement profile.

2. An elevator method, comprising:

determining, for an elevator cage in an elevator installation, a movement profile of the elevator cage for movement of the elevator cage to a destination stopping point position in the elevator installation, the determining being based at least in part on an anticipated slip between a drive pulley and a support coupled to the elevator cage;

detecting a movement of the elevator cage based at least in part on signals of a rotary encoder coupled to the drive pulley or to a drive motor;

during the movement of the elevator cage, controlling the drive motor based at least in part on the signals of the rotary encoder and the movement profile;

determining an actual travel distance between an instantaneous elevator cage position and the destination stopping point position; and determining a slip-corrected travel distance based at least in part on the actual travel distance and the anticipated slip between the drive pulley and the support, wherein the movement profile is determined based at least in part on the slip-corrected travel distance and is determined for travel of the elevator cage from the instantaneous cage position to the destination stopping point position.

3. The elevator method of claim 2, the slip-corrected travel distance being further based on one or more slip factors, the one or more slip factors having different respective sizes, the different respective sizes being related to respective cage loads.

4. An elevator method, comprising:

determining, for an elevator cage in an elevator installation, a movement profile of the elevator cage for movement of the elevator cage to a destination stopping point position in the elevator installation, the determining being based at least in part on an anticipated slip between a drive pulley and a support coupled to the elevator cage;

detecting a movement of the elevator cage based at least in part on signals of a rotary encoder coupled to the drive pulley or to a drive motor;

during the movement of the elevator cage, controlling the drive motor based at least in part on the signals of the rotary encoder and the movement profile;

wherein the destination stopping point position is one of a plurality of stopping point positions in the elevator installation, the stopping point positions comprising respective stopping point markings, the stopping point markings being detectable by at least one stopping point sensor coupled to the elevator cage, the stopping point markings having a dimension at least twice as long as a stopping distance for the elevator cage.

5. An elevator method, comprising:

determining, for an elevator cage in an elevator installation, a movement profile of the elevator cage for movement of the elevator cage to a destination stopping point position in the elevator installation, the determining being based at least in part on an anticipated slip between a drive pulley and a support coupled to the elevator cage;

detecting a movement of the elevator cage based at least in part on signals of a rotary encoder coupled to the drive pulley or to a drive motor;

during the movement of the elevator cage, controlling the drive motor based at least in part on the signals of the rotary encoder and the movement profile;

moving the elevator cage from an instantaneous elevator cage position to a stopping marking point of an intermediate stopping point position or a stopping marking point of the destination stopping point position;

after reaching the stopping marking point of the intermediate stopping point position or the stopping marking point of the destination stopping point position, correcting a registered elevator cage position; and after reaching the stopping marking point of the intermediate stopping point position or the stopping marking point of the destination stopping point position, correcting the movement profile of the elevator cage based at least in part on a residual distance to the destination stopping point position.

6. An elevator method, comprising:

determining, for an elevator cage in an elevator installation, a movement profile of the elevator cage for movement of the elevator cage to a destination stopping point position in the elevator installation, the determining being based at least in part on an anticipated slip between a drive pulley and a support coupled to the elevator cage;

detecting a movement of the elevator cage based at least in part on signals of a rotary encoder coupled to the drive pulley or to a drive motor;

during the movement of the elevator cage, controlling the drive motor based at least in part on the signals of the rotary encoder and the movement profile;

performing a learning trip of the elevator cage, the performing the learning trip comprising determining stopping point position values for one or more stopping points in the elevator installation.

7. The elevator method of claim 6, further comprising: determining a learning trip slip factor; and correcting the determined stopping point position values based at least in part on the learning trip slip factor.

8. The elevator method of claim 7, the determining a learning trip slip factor comprising: determining a first travel distance between a point at a start of an outward journey of the elevator cage and reversal point at the end of the outward journey, the determining being based on a first set of signals received from the rotary encoder; determining a second travel distance between the reversal position at the end of the outward journey and the point at the start of the outward journey, the determining being based on a first set of signals received from the rotary encoder; calculating the learning trip slip factor by dividing a difference between the first and second travel distances by a sum of the first and second travel distances.

9. The elevator method of claim 6, the learning trip being performed with a cage loading of less than 30 percent of a rated load for the elevator cage.

10. The elevator method of claim 6, the performing the learning trip further comprising: performing an outward journey with the elevator cage; during the outward journey, detecting a zero position marking using a stopping point position sensor coupled to the elevator cage; during the outward journey, detecting respective stopping point markings of one or more stopping points in the elevator installation using the stopping position sensor; performing a return journey with the elevator cage; during the return journey, detecting the zero position marking using the stopping position sensor; during the return journey, detecting the respective stopping point markings using the stopping position sensor; as a result of the detecting the respective stopping point markings during the return journey, correcting respective detected travel distances from the zero position marking by half of a stopping point marking length; and registering the corrected respective detected travel distances as respective stopping point position values.

11. An elevator method, comprising:

determining, for an elevator cage in an elevator installation, a movement profile of the elevator cage for movement of the elevator cage to a destination stopping point position in the elevator installation, the determining being based at least in part on an anticipated slip between a drive pulley and a support coupled to the elevator cage;

detecting a movement of the elevator cage based at least in part on signals of a rotary encoder coupled to the drive pulley or to a drive motor;

during the movement of the elevator cage, controlling the drive motor based at least in part on the signals of the rotary encoder and the movement profile;

determining a first value for a defined travel distance between a start stopping point and a destination stopping point based on a first set of signals from the rotary encoder; determining a second value for the defined travel distance based on a start stopping point position value and a destination stopping point position value;

determining a cage loading range for the elevator cage; storing a quotient of the first and second values as an actual value slip factor, the actual value slip factor being stored in association with the cage loading range.

12. The elevator method of claim 11, further comprising storing the quotient in association with an elevator cage travel direction.

13. The elevator method of claim 11, further comprising: storing a plurality of actual value slip factors; and determining a mean of the stored plurality of actual value slip factors.

14. An elevator method, comprising:

determining, for an elevator cage in an elevator installation, a movement profile of the elevator cage for movement of the elevator cage to a destination stopping point position in the elevator installation, the determining being based at least in part on an anticipated slip between a drive pulley and a support coupled to the elevator cage;

detecting a movement of the elevator cage based at least in part on signals of a rotary encoder coupled to the drive pulley or to a drive motor;

during the movement of the elevator cage, controlling the drive motor based at least in part on the signals of the rotary encoder and the movement profile;

determining an updated movement profile of the elevator cage based on a current load-dependent slip factor.

15. An elevator installation comprising:

an elevator cage disposed in a shaft; a drive pulley;

a support coupled to the elevator cage and to the drive pulley;

a rotary encoder coupled to the drive pulley or to a drive motor; and an elevator control unit, the elevator control unit being configured to, receive a movement profile of the elevator cage for a movement of the elevator cage to a destination stopping point position in the shaft, the movement profile being based at least in part on an anticipated slip between the drive pulley and the support, detect a movement of the elevator cage based at least in part on signals of the rotary encoder, and during the movement of the elevator cage, controlling the drive motor based at least in part on the signals of the rotary encoder and the movement profile.

16. An elevator system component, comprising:

at least one processor;

a memory having stored therein instructions which, when executed by the processor, cause the processor to, determine, for an elevator cage in the elevator installation, a movement profile of the elevator cage for a movement of the elevator cage to a destination stopping point position in the elevator installation, the determining being based at least in part on an anticipated slip between a drive pulley and a support coupled to the elevator cage, detect a movement of the elevator cage based at least in part on signals of a rotary encoder coupled to the drive pulley or to a drive motor, and during the movement of the elevator cage, control the drive motor based at least in part on the signals of the rotary encoder and the movement profile.

17. Method of controlling a drive motor of an elevator installation, wherein an elevator cage can be moved along a travel path by the drive motor by way of a drive pulley and at least one flexible support and stopped at stopping point positions of a plurality of stopping points, wherein a movement of the elevator cage is detected by an elevator control on the basis of signals of a rotary encoder coupled with a rotational movement of the drive motor or the drive pulley, before the start of travel of the elevator cage a movement course in the form of a trip/speed profile for travel of the elevator cage from a instantaneous elevator cage position to a destination stopping point position is calculated, and anticipated slip between the drive pulley and the support means is included in the calculation of the trip/speed profile and during travel of the elevator cage a rotational movement of the drive motor and thus of the drive pulley is controlled by the elevator control in dependence on the calculated trip/speed profile and on signals of the rotary encoder.

18. A memory having encoded thereon instructions which, when executed by a processor, cause the processor to perform a method, the method comprising:

determining, for an elevator cage in the elevator installation, a movement profile of the elevator cage for a movement of the elevator cage to a destination stopping point position in the elevator installation, the determining being based at least in part on an anticipated slip between a drive pulley and a support coupled to the elevator cage;

detecting a movement of the elevator cage based at least in part on signals of a rotary encoder coupled to the drive pulley or to a drive motor; and during the movement of the elevator cage, controlling the drive motor based at least in part on the signals of the rotary encoder and the movement profile.

* * * * *